US005479658A

United States Patent [19]

Harris

[11] Patent Number: 5,479,658

[45] Date of Patent: Jan. 2, 1996

[54] FACE MASK AND FACE MASK COVER

[76] Inventor: Daniel S. Harris, 1030 W. Elm St., Greenwood, Ind. 46142

[21] Appl. No.: 285,894

[22] Filed: Aug. 4, 1994

[51] Int. Cl.[6] ..... A42B 3/18

[52] U.S. Cl. ..... 2/9; 2/424

[58] Field of Search ..... 2/410, 422, 424, 2/425, 9; 40/584, 617, 308

[56] References Cited

U.S. PATENT DOCUMENTS

| | | | |
|---|---|---|---|
| 2,880,533 | 4/1959 | Troendly | 40/617 |
| 2,902,786 | 9/1959 | Schneider | 40/617 |
| 3,782,747 | 1/1974 | Hamilton, Jr. | 40/308 |
| 4,031,564 | 6/1977 | Wood | 2/9 |
| 4,736,466 | 4/1988 | Kallstrom . | |
| 4,999,856 | 3/1991 | DuVall . | |
| 5,093,936 | 3/1992 | Copeland et al. | 2/424 |
| 5,216,758 | 6/1993 | Rabquer . | |

*Primary Examiner*—C. D. Crowder
*Assistant Examiner*—Michael A. Neas
*Attorney, Agent, or Firm*—Lundy and Associates

[57] ABSTRACT

An improved face mask and face mask cover for a football helmet comprising a sheet of rigid material formed to overlie a conventional face mask. The sheet having upper and lower peripheral portions rolled to extend over the rods defining an area over which the sheet extends. The sheet covers the area encompassed by the rods. The sheet has an exterior surface on which a face mask design may be placed. A plurality of loop straps extend over the face mask bars and are secured to the sheet securing the face mask cover to the face mask. The face mask design may be coordinated with the helmet design to result in a face mask and helmet design never before possible.

21 Claims, 3 Drawing Sheets

FACE MASK AND FACE MASK COVER

BACKGROUND OF THE INVENTION

The present invention generally relates to football helmet face masks of the type worn by running backs and linemen in most organized football, and more particularly to a face mask cover on which decoration can be placed coordinated with helmet decoration.

Football helmets and face masks have been utilized in most organized football leagues for the past decade. Face masks are traditionally manufactured from steel rod, bent to shape, welded together, and attached to the helmet by bolts threaded into the helmet structure. While helmets have long been decorated with colors, team logos, stripes, and the like, face masks remain undecorated because of their manufacture from steel rod.

It is therefore highly desirable to provide an improved face mask and face mask cover.

It is also highly desirable to provide an improved face mask and face mask cover which can be decorated in a manner to coordinate with helmet decorations.

It is also highly desirable to provide an improved face mask and face mask cover which may be molded to accentuate the overall helmet and face mask design.

Football helmets and face masks must also be designed for safety. Helmet spearing has been barred in most organized football leagues, and while helmets are hard, they are smooth without rough edges, cutting edges, protrusions, and the like. Face masks must also have these characteristics.

Therefore, it is highly desirable to provide an improved face mask and face mask cover on which helmet designs may be continued which are smooth, without sharp edges and without protrusions.

Football helmets and face masks also must be durable. In play, football helmets and face masks take considerable pounding and abuse.

Thus, it is highly desirable to provide an improved face mask and face mask cover which is highly durable and will withstand the abuse of a conventional football helmet during play.

It is finally highly desirable to provide an improved face mask and face mask cover which have all of the above desired features.

SUMMARY OF THE INVENTION

It is therefore an object of this invention to provide an improved face mask and face mask cover.

It is also an object of the invention to provide an improved face mask and face mask cover which can be decorated in a manner to coordinate with helmet decorations It s also an object of the invention to provide an improved face mask and face mask cover which may be molded to accentuate the helmet and face mask design.

It is also an object of the invention to provide an improved face mask and face mask cover on which helmet designs may be continued which are smooth, without sharp edges and without protrusions.

It is also an object of the invention to provide an improved face mask and face mask cover which is highly durable and will withstand the abuse of a conventional football helmet during play.

It is finally an object of the invention to provide an improved face mask and face mask cover which have all of the above desired features.

In the broader aspects of the invention, there is provided an improved face mask and face mask cover for a football helmet comprising a sheet of rigid material formed to overlie a conventional face mask. The sheet having upper and lower peripheral portions rolled to extend over the rods defining an area over which the sheet extends. The sheet covers the area encompassed by the rods. The sheet has an exterior surface on which a face mask design may be placed. A plurality of loop straps extend over the face mask bars and are secured to the sheet securing the face mask cover to the face mask. The face mask design may be coordinated with the helmet design to result in a face mask and helmet design never before possible.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
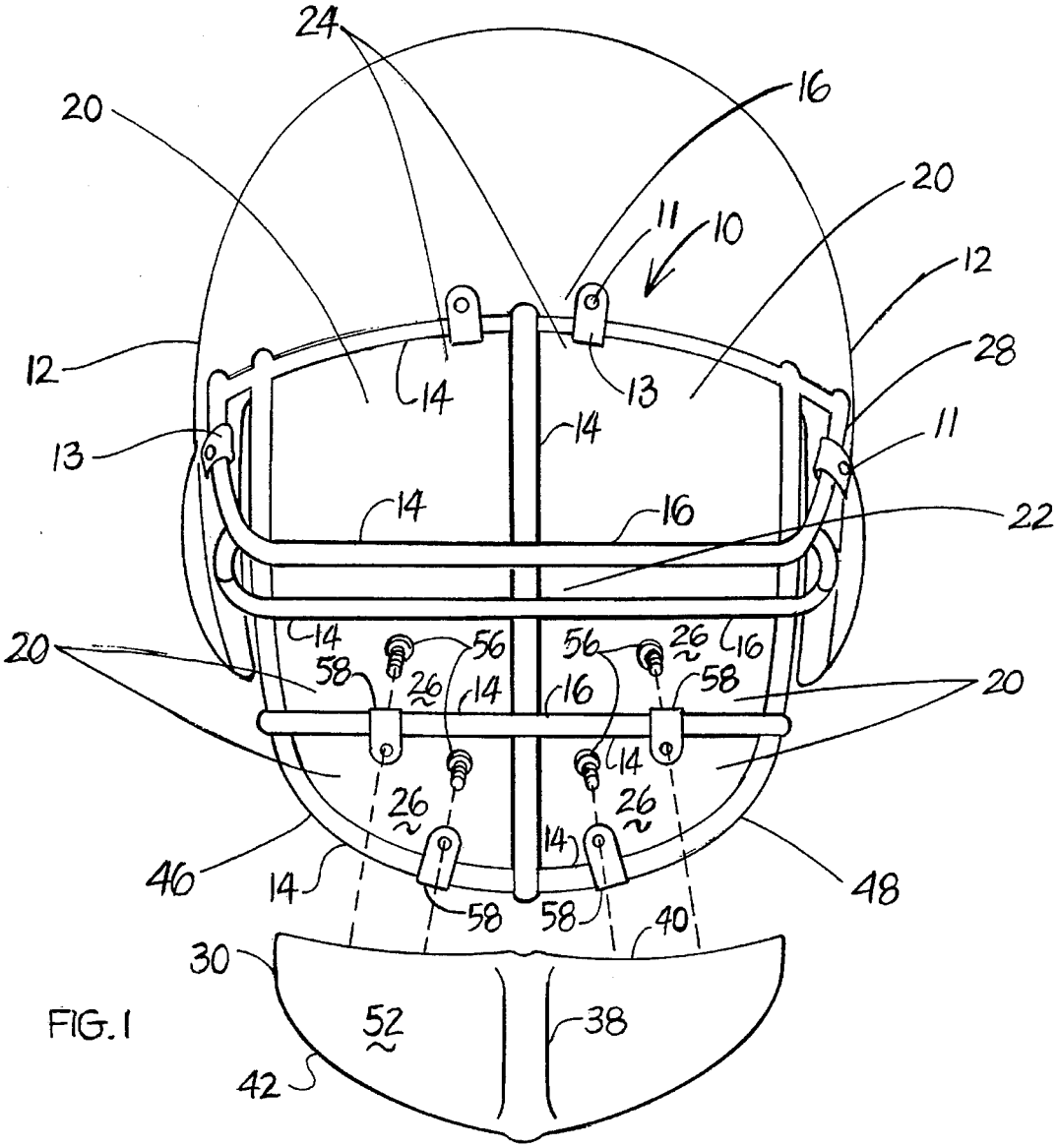
FIG. 1 is an exploded front view of a face mask showing the face mask cover of the invention mounted on a lineman's face mask.

The improved face mask 10 of the invention is secured to a football helmet 12 in a conventional manner by bolts 11 and loop straps 13. Face mask 10 comprises a plurality of spaced apart bars 14 extending over the face portion of the helmet. In prior face masks, these bars are steel or plastic or plastic composites. A number of these bars 14 are horizontal bars 16 which extend generally horizontally across the face portion of the helment in a spaced apart fashion. At least one bar 15 extends generally vertically between the horizontal bars 16 defining open areas 20 between bars 16, 18. In general, there is a reinforced nose portion 22 of the face mask 10, a viewing portion 24 behind which the eyes are located, and a jaw portion 26. The nose portion 22 is positioned between the viewing portion 24 and the jaw portion 26.

Figure 2:
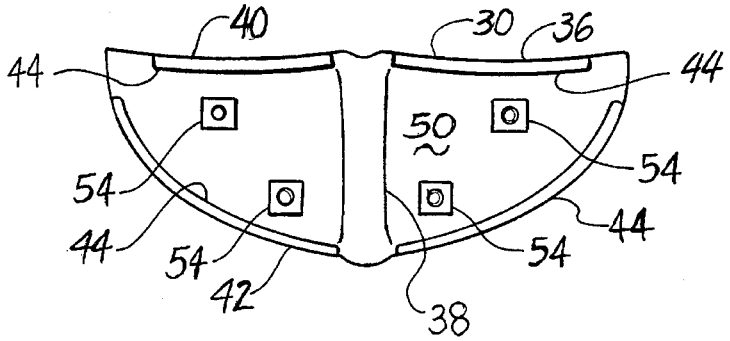
FIG. 2 is a rear view of the lineman's face mask cover of the invention shown in FIG. 1.
Figure 3:
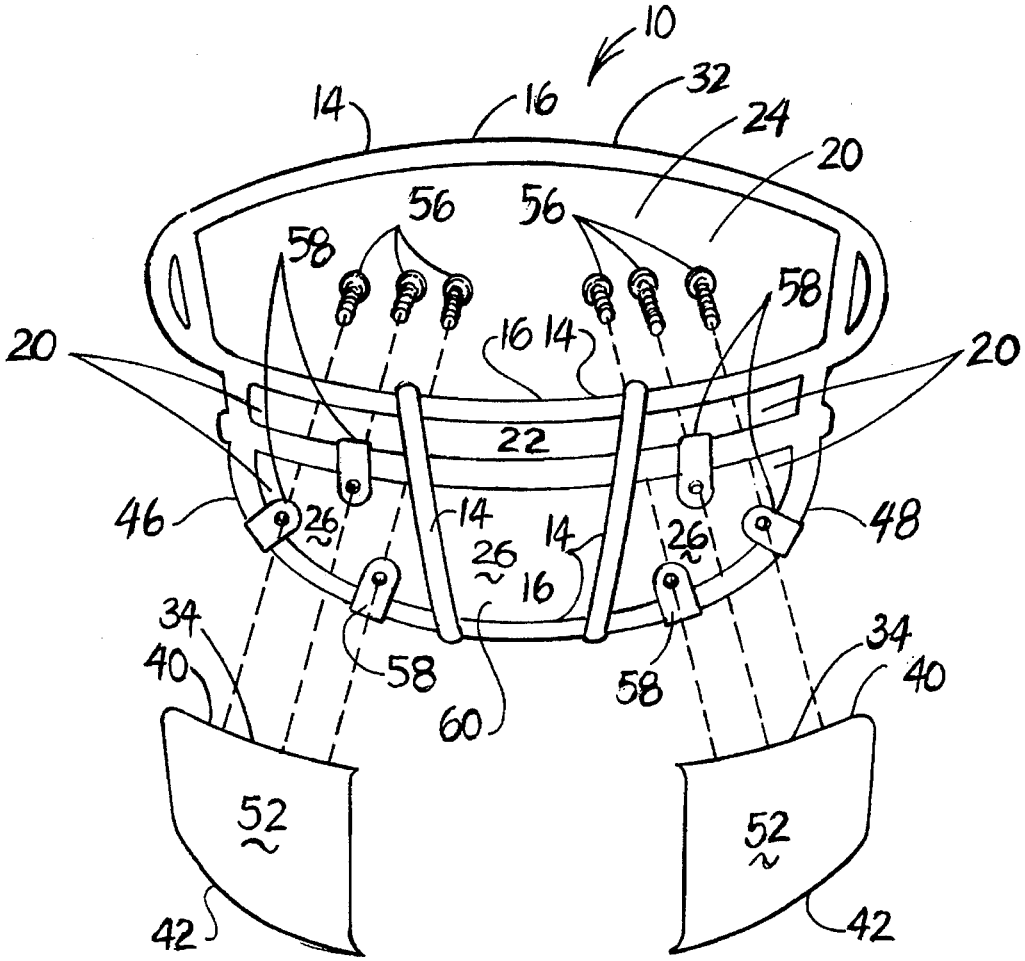
FIG. 3 is a figure like FIG. 1 showing the face mask cover of the invention mounted on a running back's helmet.
Figure 4:
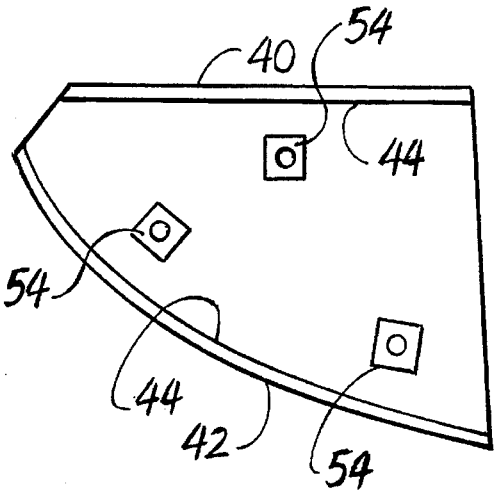
FIG. 4 is like FIG. 2 showing the rear of the running back's face mask cover of the invention.
Figure 5:
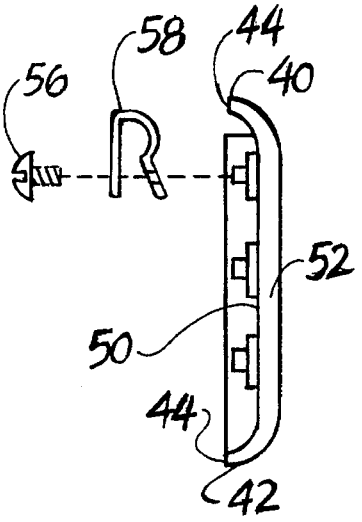
FIG. 5 is an expanded side view of the running back's face mask cover of the invention shown in FIG. 4.

In the figures, there is shown a lineman's face mask 28 with the face mask cover 30 of the invention in FIGS. 1 and 2 and a running back's face mask 32 with the covers 34 of the invention in FIGS. 3–5.

The lineman's cover 30 includes a single sheet 36 of rigid material formed to cover the jaw portion 26 of the face mask 28 between spaced apart bars 14, 16. A formed central portion 38 is positioned to extend vertically in the lineman's face mask cover 30 of the invention to overlay the central vertical bar 14 of the face mask 28. Spaced upper and lower boundaries 40, 42 of the face mask cover 30 of the invention are rolled to form edges 44 to the shape of the bars 14 to extend over the spaced apart bars 16 of the face mask 28 defining the upper and lower boundaries 40, 42 of the jaw portion 26 of the face mask 28. The face mask cover 30 of the invention covers the entire jaw portion 26 between the spaced apart bars 16 and between opposites sides 46, 48.

The lineman's face mask cover 30 has an inside surface 50 and an outside surface 52. Outside surface 52 is smooth without any exposed edges or protrusions. Rolled edges 44 extend inwardly of the face mask 28 and are closely contiguous and superimposed over bars 14. In the embodiment illustrated, interior surface 50 has a plurality of nuts 54 welded to the interior surface 50 to accommodate bolts 56 and loop straps 58. Each of the loop straps 58 is positioned over one of the bars 14 and the bolts 56 extend through the holes 60 adjacent the distal ends of each loop strap 58 and secured in one of the nuts 54. When bolts 56 are tightened, bars 14 are clamped within strap 58 to secure the face mask cover 30 to the face mask 28.

Referring to FIGS. 3, 4, and 5, a running back face mask 32 of the invention is shown with two covers 34, one of which is formed as a mirror image of the other. One of the face mask covers 34 of this embodiment is secured to the left side of the face mask 32 between bars 16 of jaw portion 26 of face mask 32 and extends from a central vertical member 14 to the periphery of side 48. The other cover 34 of this embodiment is secured to the right side 46 of the face mask 32 between bars 16 and extends from a vertical central member 14 to the periphery of the opposite side 46 leaving an uncovered front portion 60 therebetween. The pair of face mask covers 34 of this embodiment are secured to face mask 10 in a similar fashion to the lineman's cover by loop straps 58, nuts 54 secured to the inside surface 50 of face mask covers 34, and bolts 56 as shown in FIG. 4.

In both of the embodiments illustrated, sheet material is rolled to curve over the face mask bars 14 and to position the edges 44 adjacent bars 14 on the inner portion of the face mask 10 such that the exterior surface 52 of the face mask covers 30, 32 is smooth without rough edges or protrusions. The exterior surfaces 52 bear design indicia complementary with the helmet design, or decals, striping, or other design indicia.

In specific embodiments, loop straps 58 may be stamped from sheet metal or plastic or plastic composite material and otherwise formed into the shape shown, nuts 54 may be T-nuts as produced by Schutt Mfg. Co. of Litchfield, Ill. Bolts 56 may be conventional. Face mask cover 10 may be formed of sheet metal or molded of plastic or plastic composites. In one specific embodiment face masks 28 and 32 and covers 30 and 34, respectively, are integrally molded as a single piece of plastic or plastic composites, and the loop straps 58, nuts 54 and bolts 56 are eliminated.

In operation, the improved face mask covers 30, 34 of the invention are integrally molded with or secured to the improved face masks 28 and 32 of the invention. The face mask 10 of the invention protects the face of the athlete wearing a helmet 12 with face mask 10 securely attached thereto in the same fashion as prior face masks have.

Figure 6:
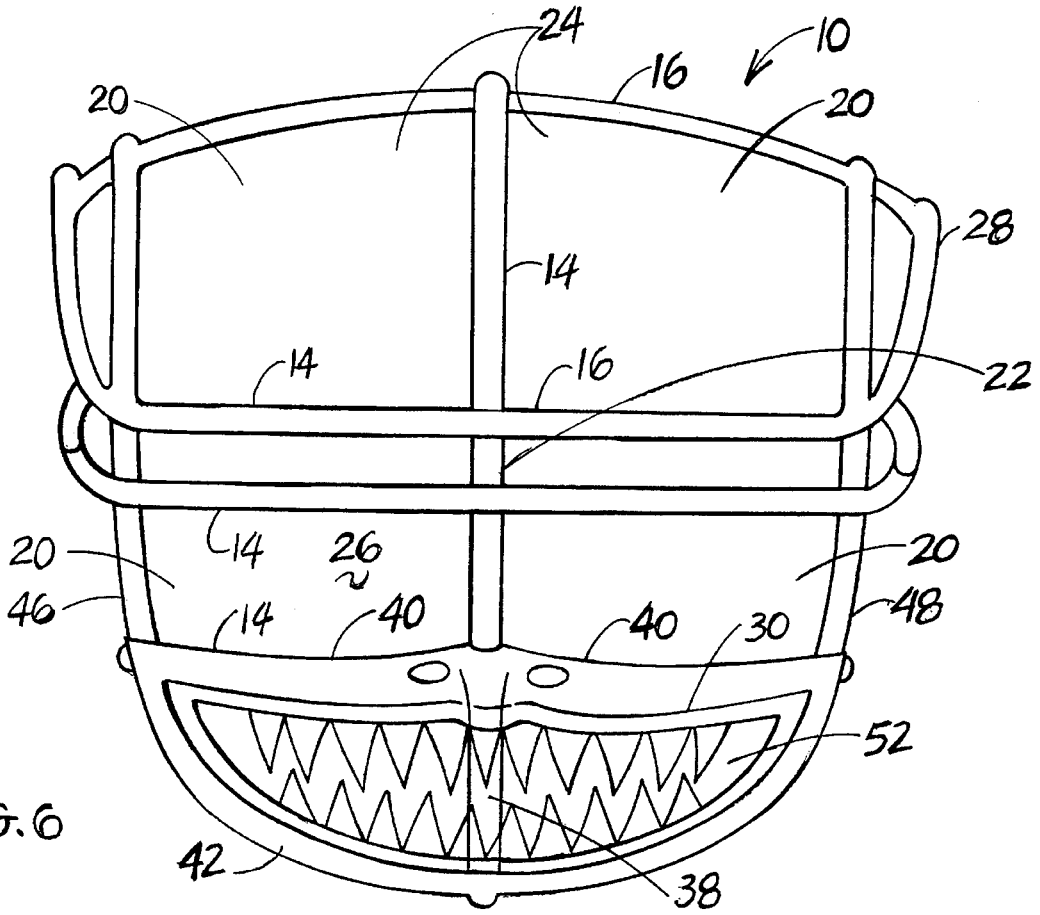
FIG. 6 is a front view of the face mask cover of the invention shown in FIGS. 1 and 2 including design and indicia complementary with the helmet design.
Figure 7:
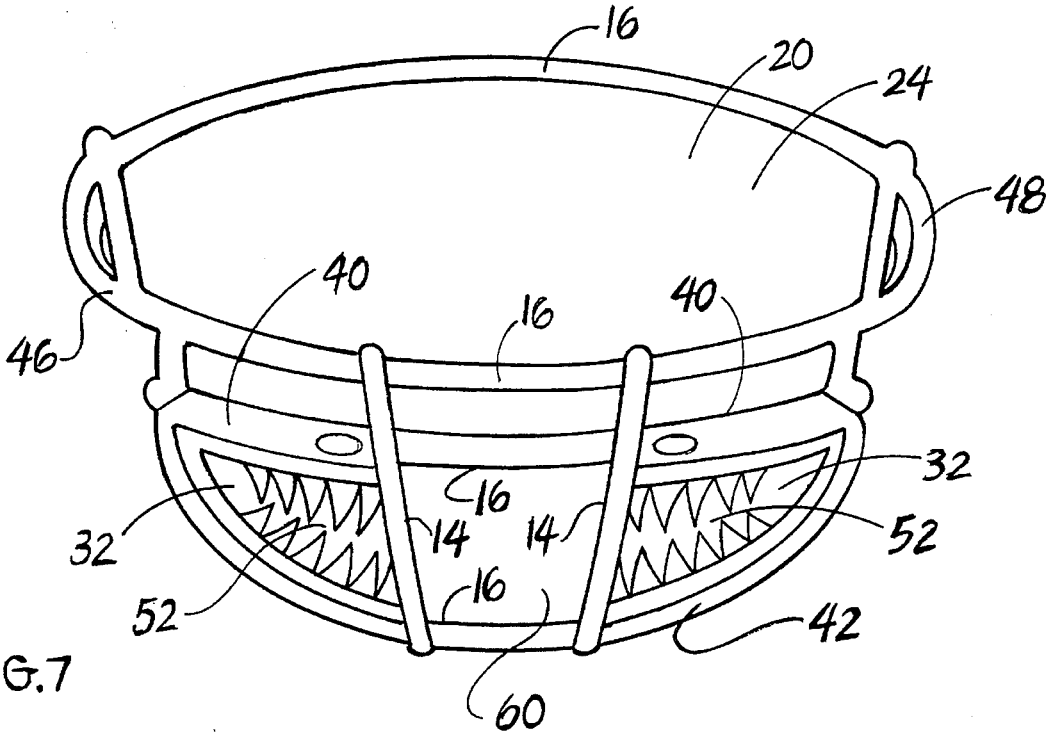
FIG. 7 is like FIG. 6 showing the face mask cover of the invention shown in FIGS. 3 and 4.

The exterior surface 52 of the face mask 10, however, has an exterior surface capable of bearing design indicia which, in most embodiments, is complementary with the helmet design indicia. See FIGS. 6 and 7.

Exterior surface 52 of the face mask covers 30, 32 has no exposed edges or any protrusions such that the face mask covers 30, 32 of the invention does not cause injury over and above those caused by a conventional helmet face mask.

The face mask 10 and covers 30, 32 of the invention do not impair the breathing of the athlete, the vision of the athlete or in any way the use of helmet 12. The player wearing the face mask 10 with the covers 30, 32 of the invention attached thereto experiences no difference than wearing a conventional helmet 12 with a conventional face mask. The face mask 10, however, can be decorated with indicia corresponding with the helmet indicia, or other indicia identifying the team as desired.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A football helmet face mask and cover comprising a sheet of rigid material formed to overlie spaced bars of the face mask, said sheet having upper and lower boundaries, said upper and lower boundaries being rolled to conform to and to extend over the spaced bars of said face mask, said sheet covering the area between said bars, said cover having an inside surface and an outside surface, said rolled boundaries being rolled toward said inside surface, said exterior surface accommodating design indicia complementary with the helmet design whereby said helmet and face mask have a coordinated design presentation.

2. The face mask cover of claim 1 wherein said sheet material is plastic.

3. The face mask cover of claim 1 wherein said sheet material is metal.

4. The face mask cover of claim 1 wherein said sheet material is plastic composite.

5. The face mask cover of claim 1 wherein said sheet and rolled boundaries thereof have no exposed edges or protrusions.

6. The face mask cover of claim 5 wherein each of said boundaries have edges adjacent a bar of said face mask.

7. The face mask cover of claim 1 wherein said sheet being adapted to be secured to said bars of said face mask.

8. The face mask cover of claim 7 further comprising a plurality of loop straps, said loop straps extending over said bars and being secured to said inside surface of said sheet.

9. The face mask cover of claim 7 wherein said cover is integrally molded as a single piece with said face mask.

10. The face mask cover of claim 1 wherein said sheet covers the entire lower portion of said face mask.

11. The face mask cover of claim 1 wherein said sheet covers only a side portion of said face mask.

12. A face mask for a helmet comprising a plurality of spaced apart bars extending over the jaw portion of the open front of a helmet, said face mask adapted to be secured to the boundary of said open helmet front, a sheet of rigid material formed to overlie spaced bars of said face mask, said sheet having upper and lower boundaries, said upper and lower boundaries being rolled to conform to and to extend over spaced bars of said face mask, said sheet covering the area between said bars, said sheet having an inside surface and an outside surface, said rolled boundaries being rolled toward said inside surface, said exterior surface accommodating design indicia complementary with a helmet design whereby said helmet and face mask have a coordinated design presentation.

13. The face mask of claim 12 wherein said sheet material is chosen from the group of materials consisting of metals, plastics, and composite plastics.

14. The face mask of claim 12 wherein said sheet and rolled boundaries thereof have no exposed edges or protrusions.

15. The face mask of claim 12 wherein each of said boundaries have edges adjacent a bar of said face mask.

16. The face mask of claim 12 wherein said sheet is adapted to be secured to said bars of said face mask.

17. The face mask of claim 12 further comprising a plurality of loop straps, said loop straps extending over said bars and being secured to said inside surface of said sheet.

18. The face mask of claim 12 wherein said sheet covers the entire lower portion of said face mask.

19. The face mask of claim 12 wherein said sheet covers only a side portion of said face mask.

20. The face mask of claim 12 wherein said face mask and said sheet are integrally molded as a single piece.

21. A football helmet face mask and cover, comprising a first sheet of rigid material formed to overlie spaced bars of the face mask, said first sheet having upper and lower boundaries, said upper and lower boundaries being rolled to conform to and to extend over the spaced bars of the face mask, said first sheet covering the area between said bars, said first sheet having an inside surface and an outside surface, said rolled boundaries being rolled toward said inside surface, said exterior surface accommodating design indicia complementary with helmet design whereby said helmet and face mask have a coordinated design presentation, a second sheet, said second sheet being formed as a mirror image of said first sheets, said sheet and rolled boundaries thereof having no exposed edges or protrusions, said sheets being adapted to be secured to said bars of said face mask, said first and second sheets cover the right and left side of said face mask, respectively, leaving a front portion therebetween uncovered.

* * * * *